US008507827B2

(12) United States Patent
Eftymiades

(10) Patent No.: US 8,507,827 B2
(45) Date of Patent: Aug. 13, 2013

(54) METHOD FOR THE PRODUCTION OF METAL PROFILES

(75) Inventor: Georges Eftymiades, Pibrac (FR)

(73) Assignee: Airbus Operations SAS, Toulouse (FR)

( * ) Notice: Subject to any disclaimer, the term of this patent is extended or adjusted under 35 U.S.C. 154(b) by 1117 days.

(21) Appl. No.: 10/181,235

(22) PCT Filed: May 30, 2002

(86) PCT No.: PCT/FR02/01819

§ 371 (c)(1),
(2), (4) Date: Nov. 12, 2003

(87) PCT Pub. No.: WO02/096579

PCT Pub. Date: Dec. 5, 2002

(65) Prior Publication Data

US 2004/0069755 A1 Apr. 15, 2004

(30) Foreign Application Priority Data

Jun. 1, 2001 (FR) ..... 01 07230

(51) Int. Cl.
*B23K 26/00* (2006.01)

(52) U.S. Cl.
USPC ..... 219/121.64; 219/121.67; 219/121.69

(58) Field of Classification Search
USPC ..... 219/121.64, 121.63, 121.67, 121.69; 228/171, 169, 173.3; 29/897.34, 897.35
See application file for complete search history.

(56) References Cited

U.S. PATENT DOCUMENTS

| | | | | | |
|---|---|---|---|---|---|
| 1,693,045 | A | * | 11/1928 | Murray | 228/155 |
| RE22,954 | E | * | 12/1947 | Howard | 174/138 E |
| 3,268,985 | A | * | 8/1966 | Smith | 29/897.35 |
| 3,540,395 | A | * | 11/1970 | Skinner | 72/129 |
| 3,716,347 | A | * | 2/1973 | Bergstrom et al. | 428/550 |
| 3,785,631 | A | * | 1/1974 | Prye | 266/71 |
| 4,041,270 | A | | 8/1977 | Akahide et al. | 219/73 |
| 4,097,716 | A | | 6/1978 | Reichelt, Jr. et al. | 219/137 |
| 4,514,613 | A | | 4/1985 | Hill et al. | 219/121 |
| 5,362,935 | A | * | 11/1994 | Ariyasu et al. | 219/56 |
| 5,393,956 | A | | 2/1995 | Guth et al. | 219/121.64 |
| 5,603,853 | A | * | 2/1997 | Mombo-Caristan | 219/121.64 |
| 5,704,570 | A | * | 1/1998 | Irie et al. | 246/454 |
| 6,128,546 | A | * | 10/2000 | Basista et al. | 700/166 |
| 6,769,597 | B1 | * | 8/2004 | Seizu | 228/152 |
| 6,886,251 | B1 | * | 5/2005 | Andrews | 29/897.35 |

FOREIGN PATENT DOCUMENTS

| | | | |
|---|---|---|---|
| DE | 195 33 831 | C1 | 1/1997 |
| EP | 0 531 139 | A1 | 3/1993 |
| FR | 833804 | | 11/1938 |
| FR | 1442875 | | 5/1966 |
| GB | 2099655 | * | 12/1982 |

* cited by examiner

*Primary Examiner* — M. Alexandra Elve
(74) *Attorney, Agent, or Firm* — Nixon Peabody LLP

(57) ABSTRACT

To create a metal section (P3) of complex shape, a three-dimensional drawing is made of the final size, then plane drawings are developed and made of each of the elements that form a distinct part of the section. These elements are then cut out (A3, B3) in at least one metal plate. Cutting operations are preferably executed flat in the flat plate. If necessary, at least one of the elements (A3, B3) is then formed. Lastly, the elements (A3, B3) are assembled together by welding for example, to form the section (P3).

18 Claims, 5 Drawing Sheets

METHOD FOR THE PRODUCTION OF METAL PROFILES

TECHNICAL FIELD

This invention concerns a manufacturing method for metal sections, and more precisely, a method that permits the manufacture of metal sections of complex form, that present for example, three dimensional geometry, evolutional radius of curvature, a variable thickness and/or wings that form evolutional angles with each other in cross section.

The term "sections with a complex form" refers to sections whose various component elements have a non-plane form.

STATE OF THE ART

An initial recognised manufacturing method for metal sections comprises the extrusion of a metal bar. This provides rectilinear sections. These sections are then formed, if necessary, by bending for example. For certain materials such as titanium, bending must be performed at high temperature. Since it is difficult to obtain a piece with the required measurements using this method directly, generally the piece is produced slightly larger than requirements, then completed to specification by machining.

This method presents several problems. First of all it is long and difficult to set up. Moreover, it is expensive because of the numerous operations that need to be performed (extrusion, forming, machining). In addition, forming operations applied to a previously extruded section results in provoking mechanical stress in the section structure, and this can lead to reduced resistance capacity in certain zones of the said structure.

Another recognised manufacturing technique for metal sections comprises the direct production through moulding. The sections are therefore obtained in a single operation, by performing a high precision mould casting directly to specified measurements.

This method presents the problem of requiring the same number of moulds as the existing number of different shapes and measurements. Mould costs are very expensive.

Moreover, this method is difficult to set up for sections that are very long compared to their width, such as sections several metres long (in particular, those over 5 metres long) with shapes such as T, I, H, or N, or any other sections where the wings measure only a few tens of millimetres in width, while the thickness ranges between 1.5 to 2 mm. In this case there is a risk that the metal will not cool in a uniform manner throughout the volume, and this can provoke weak points in the section structure.

Moreover, the manufacturing method using moulding applied to very long sections requires large-scale production installations, involving very important investment.

A third recognised method is composed of producing the sections directly through machining in the mass of a metal block.

This method presents the problem of being very long to set up, because of the complicated machining cycle. In addition, it requires specific machine tools, and this too involves large investments. In fact, the production of sections over 5 metres long requires large-scale 5 axis numerical control machine tools. Last of all, this method has a major problem in that a large quantity of metal is lost (approximately 95% of the metal block is transformed into shavings). This is very expensive, especially when the metal involved is costly, such as titanium, for example.

DISCLOSURE OF THE INVENTION

The precise object of this invention is a new manufacturing method for metal sections of complex form, that does not present the problems involved with existing manufacturing methods and that permits, in particular, the manufacturing of very long sections in a manner that is relatively simple, rapid and inexpensive, without considerable metal loss.

According to this invention, this result is obtained thanks to a manufacturing method of a metal section when viewed as a cross section, composed of at least two separate non-aligned parts, said method being characterised in that it is applied to the manufacturing of a section of complex form, exclusively composed of non-plane parts that combine to form an angle of any degree and evolutional according to the length of the section, and that it consists of cutting out elements from at least one metal plate, with the measurements that correspond with each of the said parts, followed by the assembly of the elements to obtain the said metal section.

When two elements need to be assembled together but not at right angles, the advantage lies in cutting a bevelled edge on at least one of the elements, before assembling it with the other.

Preferably the different elements that make up the section are cut from the flat metal plates, and then formed after assembly.

As a variation, the elements can be formed before being cut from the metal plate.

Before starting the cutting out operation in the metal plate, precise calculations are made for all possible future deformation (elongation or necking) that will be induced during forming in each element to be formed. Then the element is cut out to the measurements that have been corrected after calculating the said deformation.

According to one of the preferred set ups as described in this invention, the different elements are welded together. This assembly can be performed using at least a laser beam, preferably without the addition of other matter.

According to the structure in question, welding can be performed either in various points along the contact line between the elements, or in continuous mode along the said contact line.

Preferably, a three dimensional drawing is made of the metal section according to its final measurements, followed by a drawing of the outline of each of the elements, before beginning the cutting out operation. The most advantageous method for this operation is to use CAD tools.

Then it is possible to draw the outline of each of the elements by marking prior to cutting, using a laser beam. As a variation, the outline of the different elements can also be drawn using a light beam during cutting out operations.

When several identical sections need to be made, the identical elements are cut out to best advantage by cutting several plates stacked on top of each other.

Any hollowing out operations, that may be holes that cross through the plate or not, can be machined in at least some of the elements before or during cutting out operations.

According to one of the advantageous characteristics of this invention, in order to reduce metal waste, it is also possible to cut out several elements from the same metal plate arranging them in the most advantageous layout to eliminate waste.

The cutting out operation of the section elements is preferably performed by high-speed laser beam, or by abrasive water jet, or by using traditional mechanical machining techniques.

BRIEF DESCRIPTION OF THE TECHNICAL DRAWINGS

As an illustrative example, and in no way limitative, is a list of descriptions of the different methods for the embodiment of this invention with reference to the enclosed drawings in which.

Figure 1:
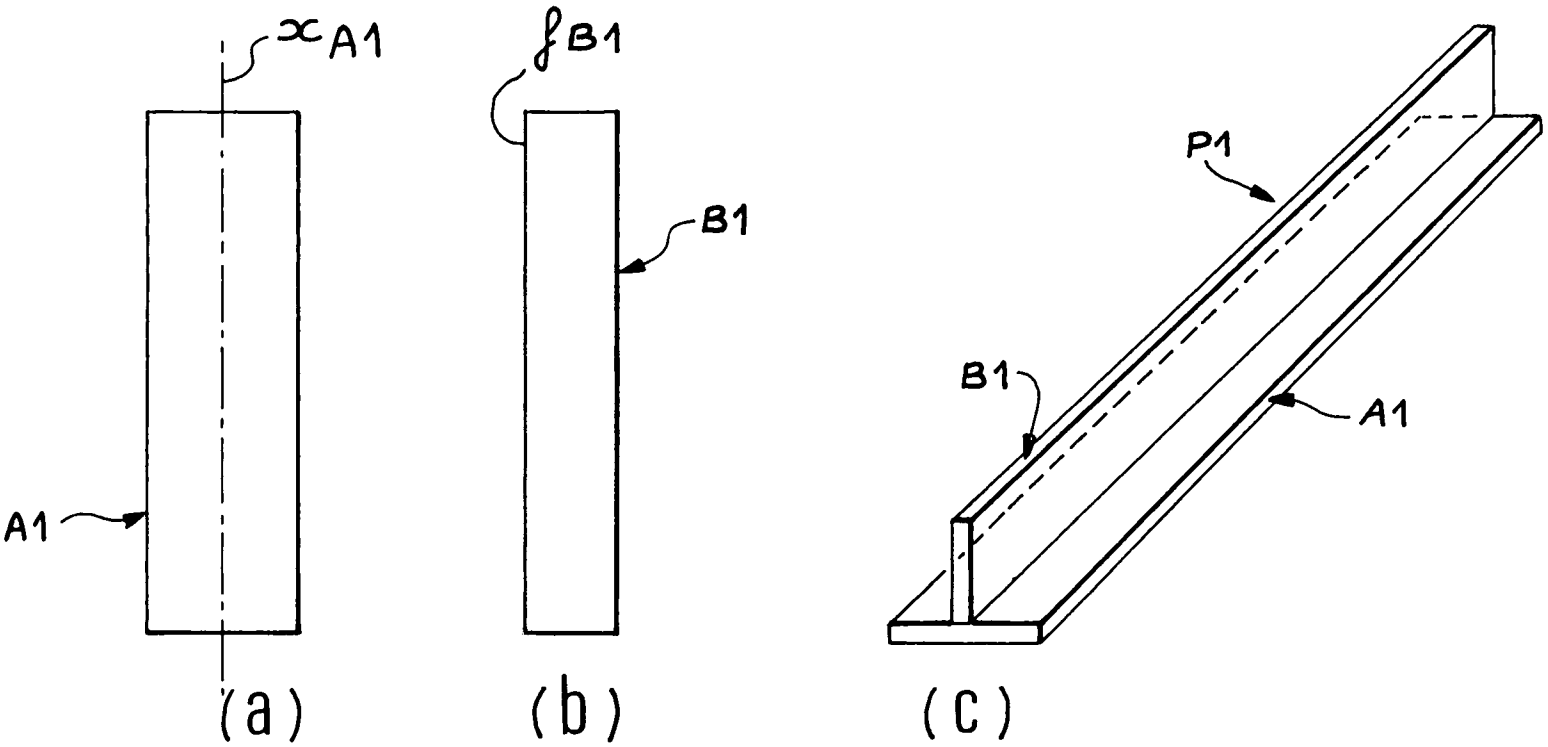
FIG. 1 is a diagram showing the various production stages of a rectilinear T-shaped section.

DETAILED DESCRIPTION OF SEVERAL PREFERABLE EMBODIMENT METHODS ACCORDING TO THIS INVENTION

To make the principle of this invention easier to understand, the embodiment methods illustrated in the figures refer to the construction of sections with a T-shaped profile. However, it is obvious that this invention must not in any way be considered limited to this type of section. On the contrary, any section that can be constructed using the method as described in the invention such as the following shaped profiles: I, H, L, etc, are included within the concept of this invention.

Metal sections envisaged for production are first of all drawn according to their final shape, according to the various appropriate viewpoints to establish the three dimensional geometry. This initial operation is preferably performed using CAD tools.

Using this overall drawing as a base, further drawings are made of all the elements that will be assembled to form the section. Each of these drawings shows one of the component elements in three-dimensional form. The division of the overall drawing into individual drawings for each of the elements is also preferably performed using CAD tools.

Each of the elements defined in this manner is then developed to obtain a flat outline of a piece that will constitute the element in question after forming. The outline is established taking into consideration all elongation and/or necking that may occur during the forming process. For this purpose, calculations are made concerning the deformation that will be induced in the element in question during forming, and the corrected measurements are established for the flat outline that will be cut out for the element, keeping in mind the deformation changes. For this operation, any appropriate methods may be used, preferably computer aided techniques.

In cases where several identical sections are to be produced, the stages described above are set up as a single operation before production start-up. However, on the contrary, the stages described below are repeated during the production of each of the individual sections in an identical series.

The different metal elements that make up the section are cut out of thin metal plate according to the flat outline established previously. As an example, but in no way limiting, metal plate appropriate for this operation may have a thickness between 0.5 mm and 2.5 mm.

When several identical elements are to be produced, these elements can also be cut out simultaneously from a stack of plates.

For best results, the different elements to be cut out are placed on the plate laying out the most economical arrangement to avoid wasting metal plate. Careful layout is particularly advantageous when using expensive metals such as titanium.

The cutting out operation can be performed using any well known method, in particular high speed laser beam, abrasive water jet machines, or traditional machine tools. In this case the various metal elements can be cut out directly to the measurement of the finished pieces to a precision level of 2/10 mm.

When a laser is used to cut out the pieces, certain parameters of the laser beam can be set to greater advantage (intensity and displacement speed) according to the characteristics of the plate to be cut. In this case, it should be remembered that the same laser beam can be used to perform the prior outline marking for each of the elements to be cut out. The laser beam parameters are then modified to adjust to ensure this join.

As a variation, and in particular when a laser is not used for cutting operations, the outlines of the elements can be located on the plate using a light beam.

Generally, the cutting out operation of the various elements is performed on flat plate. This produces flat metal elements. These elements are then formed, through forming, bending, etc. in a direction that is perpendicular to their thickness.

In one of the variants of this invention, the elements can also be cut out directly from plate that has been formed previously, such as bent plate, or similar material.

In certain cases the cutting stage and the forming stage can be followed by a complementary stage for surface treatment such as degreasing, binding, clogging, etc.

Generally each of the elements that make up the section has a uniform thickness and a constant width for the total length. However, this layout should not be considered as limiting, according to this invention. On the contrary, at least some of the said elements may have a thickness that is not uniform (according to the length and/or the width of the element) and/or a variable width (in continuous and evolutionary mode or in discontinued mode) according to the length. In cases where the element has a variable thickness, this characteristic in particular can be obtained by chemical or mechanical machining, preferably after the cutting out operation.

When the different elements destined for section composition have been cut out and bent, at least two of the adjacent elements are positioned so that they are in contact with each other in the position they will occupy in the finished section. If necessary, these elements can be maintained in contact in the said relative position, using clamping equipment.

The elements positioned in this manner are then assembled together. Assembly can be performed using any appropriate means, preferably by welding.

The positioning and assembly stages are repeated as often as necessary, always keeping in mind the accessibility of the components to be welded until the final completion of the section in question. The stages repeated in this manner can concern either, at least two individual elements, or at least one individual element and at least one sub-unit composed of several elements previously assembled together, or of at least two sub-units composed of several elements previously assembled together.

FIG. 1 shows the production of a rectilinear section P1, with a T shaped cross-section.

In this case the section P1 was manufactured by assembling two flat rectangular elements A1 and B1.

Element A1 (diagram (a) in FIG. 1) forms the lower wing of the T and the element B1 (diagram (b) in FIG. 1) forms the upper wing of the T. The element B1 is positioned at a right angle to one of the faces of element A1 so that one of the lengthwise edges of the element B1 ($f_{B1}$) is in contact with the face of element A1 (described previously) along the longitudinal axis ($x_{A1}$) of this face (diagram (c) in FIG. 1). Assembly of elements a1 and B1 is preferably performed by welding, as will be described further on in greater detail.

Figure 2:
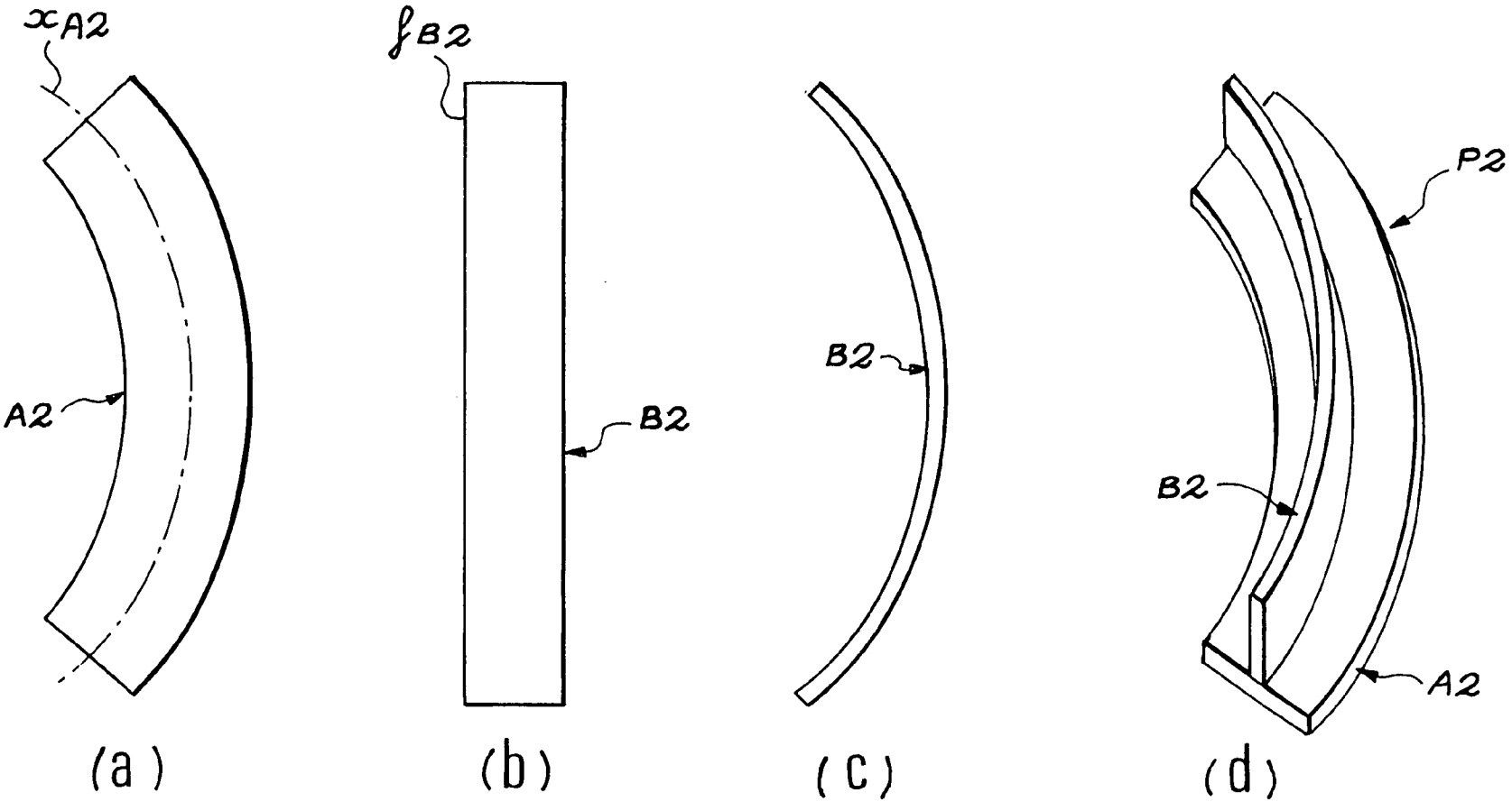
FIG. 2 is a view comparable to that shown in FIG. 1, illustrating the various production stages of a T-shaped section arched in a single direction.

FIG. 2 shows the section P2, with a T shaped cross-section, bent in a single spatial direction In this case, the section P2 is also manufactured by assembling the two elements A2 and B2.

Element A2 is flat and arc shaped (diagram (a) in FIG. 2) and forms the lower wing of the T. Element B2 that forms the upper wing of the T is obtained by cutting out a rectangular element in flat plate (diagram (b) in FIG. 2). This element is then formed to a curve that is identical to that of the longitudinal axis ($x_{A2}$) of element A2 (diagram (c) in FIG. 2). The elements A2 and B2 are then assembled, preferably through welding, by positioning the element B2 at a right angle to one of the faces of element A2 so that the lengthwise edges ($f_{B2}$) of element B2 are in contact with the said face of element A2 according to the longitudinal axis ($x_{A2}$) of this face (diagram (d) in FIG. 2).

Figure 3:
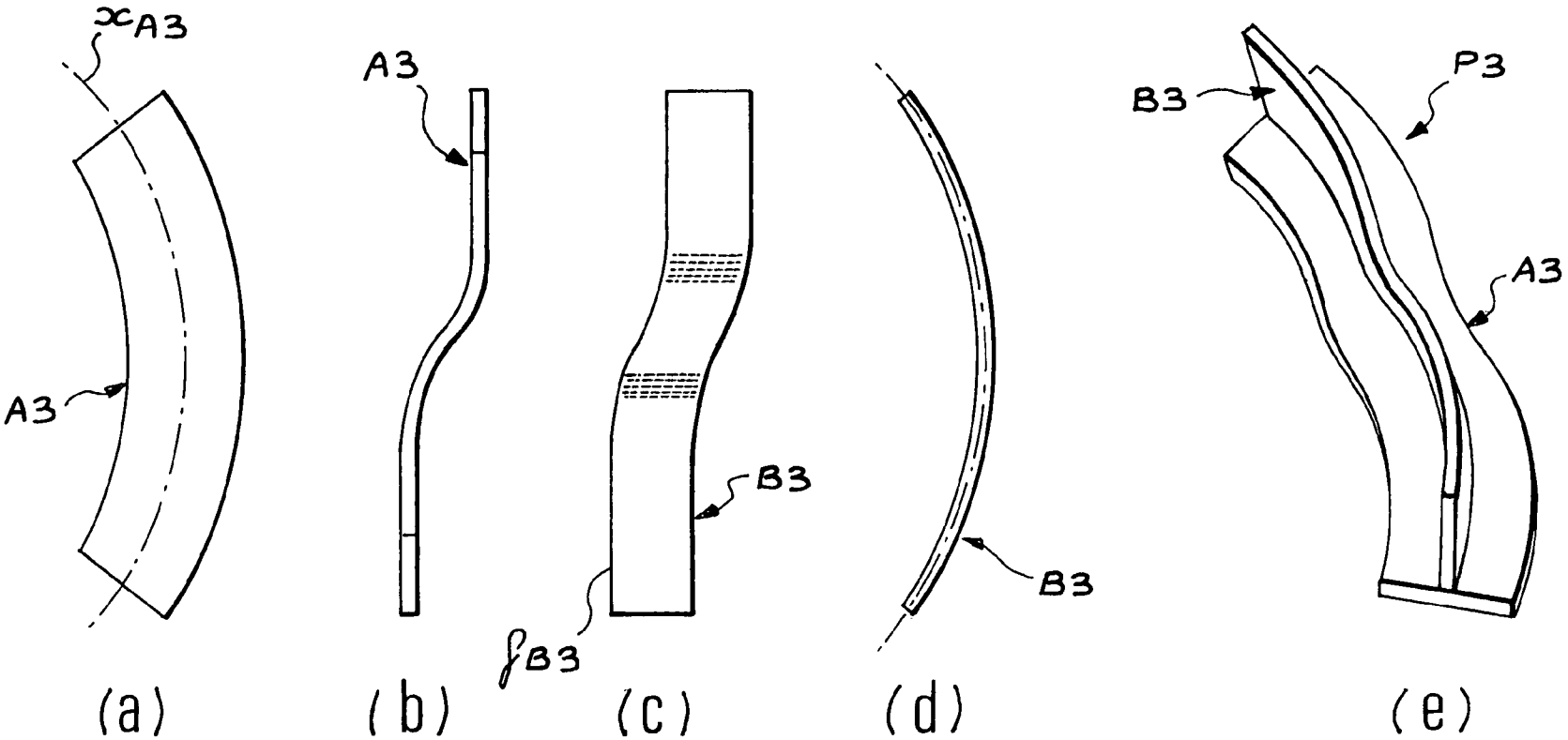
FIG. 3 is a view comparable to those shown in FIGS. 1 and 2, that show the various production stages of a T-shaped section arched in two different directions, as described in the invention.

In the embodiment method shown in FIG. 3, the method as described in this invention is applied to the production of a section P3 with a T shaped cross-section, bent in two different spatial directions, and at right angles to each other.

As described previously, the section is manufactured by assembling the elements A3 and B3, preferably through welding.

Element A3 that forms the lower wing of the T, is obtained by cutting out an element that is flat and arc shaped from flat metal plate (diagram (a) in FIG. 3. This is then bent in a direction perpendicular to its thickness as shown in diagram (b) in FIG. 3.

Element B3 that forms the upper wing of the T, is obtained by cutting out an appropriately shaped element in flat plate (diagram ⓒ in FIG. 3). This element is then bent to the same curve as the longitudinal axis ($x_{A3}$) of element A3 (diagram (d) in FIG. 3).

As shown on the right hand side of diagram (e) in FIG. 3, assembly is then performed, preferably through welding, placing element B3 in a perpendicular position against one of the faces of element A3 so that one of the longitudinal edges ($f_{B3}$) of element B3 is in contact with the said face of A3 according to the longitudinal axis ($x_{A3}$) of this face.

No matter what their shape, and as has been described previously, once the two metal elements are positioned in contact with each other, best results are obtained if they are maintained in this position with appropriate clamping equipment. This clamping equipment can be composed of wedges, presses, sash clamps, etc.

In the preferable embodiment method described in this invention where the different elements are assembled through welding, the welding seam is best created in continuous manner without the addition of other materials, using a laser beam. As a variant, the welding can be effectuated in various points along the contact line between the two elements to be assembled.

Figure 4:
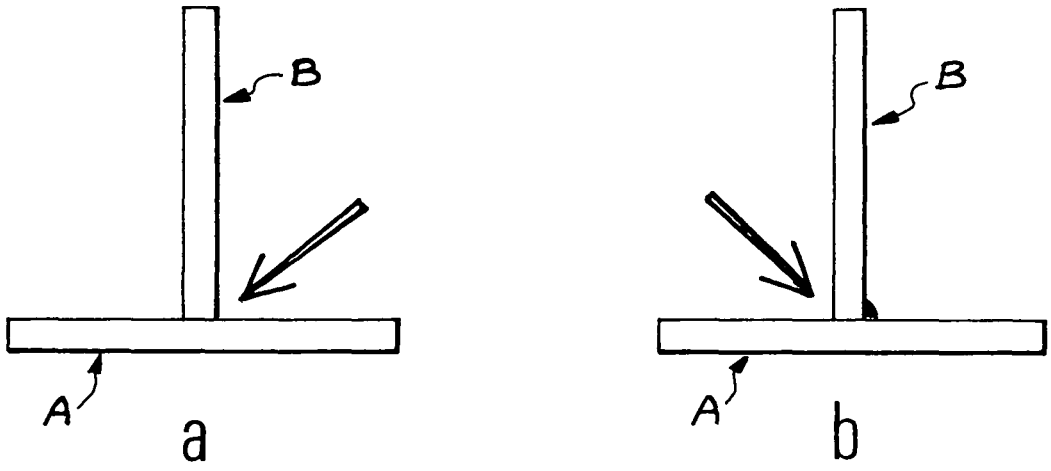
FIG. 4 is a diagram showing a cross section of the first techniques for welding the two elements that form the T as shown in FIGS. 1 to 3.

As illustrated by the arrows in (a) and (b) in FIG. 4, welding can be effectuated in two stages using a laser beam (single flux) one side and then on the other of the junction between the two elements A and, to be assembled.

Figure 5:
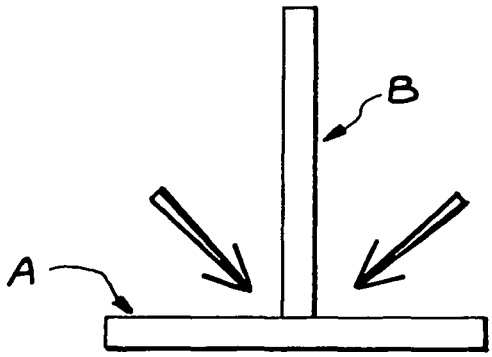
FIG. 5 is a view comparable to FIG. 4 that shows a second technique for welding the elements together.

As shown by the arrows in FIG. 5, welding can also be performed in a single operation using two laser beams (double flux) simultaneously on each side of the junction between the two elements A and B to be assembled.

Figure 6:
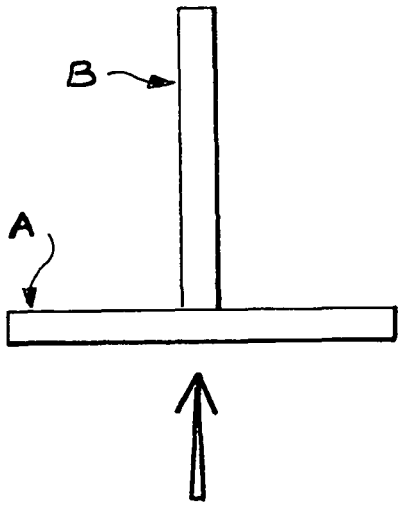
FIG. 6 is a view comparable to those in FIGS. 4 and 5 that show a third technique for welding the elements together.

As shown by the arrow in FIG. 6, welding can also be performed in a single operation (transparent) using a single laser beam when element A (or the lower element of the T) has a sufficiently fine thickness (maximum: 2.5 mm). Welding is then performed through this element A. in this case; clamping equipment is used, preferably, in order to maintain the parts to be welded in correct position, and to prevent danger of deformation. In this manner it is possible to direct the laser beam on the element B to be welded, so that the laser beam follows the line of the join, even in the case where deviation of the element B may occur for some reason.

Figure 7:
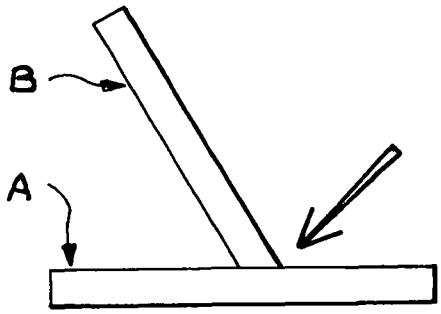
FIG. 7 is a cross section comparable to those shown in FIGS. 4 to 6 that show the assembly of two elements of a T section, that are not at right angles to each other.

In certain cases, and as described in FIG. 7, elements such as A and B that form the section P must be assembled together in a direction that is not at a right angle. Before beginning assembly, the edge of part is machined to produce a bevelled edge ready for assembly with part A, in order to form a welding edge. In this manner the edge of part B is in contact with the opposite face of part A along the total surface of the welding edge. This layout permits welding action identical to the type between two elements perpendicular to each other.

It should be noted that the angle formed between the elements such as A and B that form section P, can also be evolutionary according to the length of the section. In this case, the welding edge angle machined on the edge of part B to be assembled with part A will also be evolutionary One or several elements destined for forming a section may also necessitate complementary machining such as hollowing out. The cavities produced with this operation may fulfil various functions without deviation from the context of this invention. On the contrary, they may be holes drilled for further fixing of the section, or for the attaching of other elements on the section, fixing holes, or cable passage holes, or cavities destined to lighten the weight of the finished section while maintaining sufficient resistance against mechanical stress to which it may be subject.

These holes or cavities described above may be executed directly according to their finished diameter, preferably during the cutting out stage of the element in question. When a laser is used to perform the cutting out operations, the same laser should preferably be used to create the cavities. Hollowing and drilling before welding provides the advantage of being easier to perform because of the flat surface, and because the cutting means have already been set up. Naturally it is harder to hollow or drill in a completed section, of a three dimensional nature as is the case with extruded sections or sections machined from blocks, common in prior art. Since the outline cutout and eventual cavities are created with their final measurements, no retouching is necessary, thus saving considerable time.

The manufacturing method according to this invention presents the great advantage of providing the production of sections with complex shapes directly to the required measurements and with excellent precision levels (approximately to a few tenths of a millimetre).

The method according to the invention also permits a considerable saving in material loss. In fact, material loss is limited to off-cuts produced during outline cutout. As stated previously, these off-cuts can be reduced by positioning the different elements with the most economical layout during cutout preparation.

Given that material loss is minimal and that the method set-up is composed of very few production stages (cutting out, eventual forming, eventual surface treatment, and assembly), the manufacturing method according to this invention permits the production of sections with complex shapes at a lower cost that other methods used in prior art.

Moreover, mechanical stress in section structure is reduced to a minimum because there is no three dimensional forming, but exclusively fine plates, according to the various thicknesses. Since the thickness of these plates is reduced compared to the other measurements of the elements subject to forming, and also compared to curving radius in general set up during forming, the mechanical stress induced in the various elements that make up the section is very low.

The invention claimed is:

1. Manufacturing method for a metal profile having a T-shaped cross-section in a direction substantially orthogonal to a length direction of the profile, said metal profile including a first non-plane metal part forming a lower wing of the T-shaped cross section and a second non-plane metal part forming an upper wing of the T-shaped cross-section, said first and second non-plane metal parts being non-aligned and forming, one relative to the other, an angle evolutionary according to the length direction of said metal profile, wherein said method comprises the steps of:

defining a substantially flat outline of the first non-plane metal part and a substantially flat outline of the second non-plane metal part;

cutting out in at least one flat metal plate a first flat metal element following the flat outline of the first non-plane metal part and a second flat metal element following the flat outline of the second non-plane metal part, a longitudinal edge of the first metal element being beveled according to said evolutionary angle;

forming the first flat metal element according to the non-plane shape of the first non-plane metal part and the second flat metal element according to the non-plan shape of the second non-plane metal part; and coupling the longitudinal edge of said first metal element to a face of said second metal element to thereby form said metal profile having a substantially T-shaped cross section.

2. Manufacturing method for a metal profile having a T-shaped cross-section in a direction substantially orthogonal to a length direction of the profile, said metal profile including a first non-plane metal part forming a lower wing of the T-shaped cross section and a second non-plane metal part forming an upper wing of the T-shaped cross-section, said first and second non-plane metal parts being non-aligned and forming, one relative to the other, an angle evolutionary according to the length direction of said metal profile, wherein said method comprises the steps of:

defining a substantially flat outline of the first non-plane metal part and a substantially flat outline of the second non-plane metal part;

cutting out in at least one flat metal plate a first flat metal element following the flat outline of the first non-plane metal part and a second flat metal element following the flat outline of the second non-plane metal part;

forming the first flat metal element according to the non-plane shape of the first non-plane metal part and the second flat metal element according to the non-plane shape of the second non-plane metal part; and coupling a longitudinal edge of said first metal element to a face of said second metal element to thereby form said metal profile having a substantially T-shaped cross section.

3. Method as described in claim 2, in which one of the edges of at least one of the elements is beveled before assembly with the other element where the two elements are not perpendicular to each other.

4. Method as described in claim 2, in which said elements are cut as flat pieces from flat metal plates, then formed before assembly.

5. Method as described in claim 4, in which the deformation that will be induced in each element is calculated for forming, and there the element will be cut out to measurements corrected according to the modifications due to said deformation.

6. Method as described in claim 2, in which the elements are cut from previously formed metal plates.

7. Method as described in claim 2, in which a three dimensional drawing is made of the metal section to its final measurements, followed by a drawing of the flat outline of each of the elements before these are cut out.

8. Method as described in claim 7, in which a three dimensional drawing is made of the metal section to its final measurements, followed by a drawing of the flat outline of each of the elements using CAD tools.

9. Method as described in claim 7, in which the outline of the elements are drawn by marking with a laser beam before they are cut out.

10. Method as described in claim 7, in which the outline of the elements are drawn using a light beam before they are cut out.

11. Method as described in claim 2, in which several identical elements can be cut out simultaneously from a stack of plates.

12. Method as described in claim 2, in which several of the elements are cut from the same metal plate arranging the layout position to minimize metal waste.

13. Method as described in claim 2, in which several of the elements using a cutting technique chosen from the group, including cutting out using high speed laser beam, abrasive water jet, and traditional mechanical machining.

14. Method as described in claim 2, in which the elements are assembled, and where at least one of the elements has a variable thickness.

15. Method as described in claim 14, in which the variable thickness is obtained through chemical or mechanical machining.

16. Method as described in claim 2, in which the elements are assembled, and where at least one of the elements has a variable width.

17. Method as described in claim 2, in which the elements are assembled, and where the elements have constant width and thickness.

18. Method as described in claim 2 wherein the step of coupling comprises welding at least the longitudinal edge of the first element and the face of the second element.

* * * * *

UNITED STATES PATENT AND TRADEMARK OFFICE

CERTIFICATE OF CORRECTION

PATENT NO. : 8,507,827 B2
APPLICATION NO. : 10/181235
DATED : August 13, 2013
INVENTOR(S) : Georges Eftymiades It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 814 days.

Signed and Sealed this
Fifteenth Day of September, 2015

Michelle K. Lee

Michelle K. Lee
*Director of the United States Patent and Trademark Office*